US011761321B2

(12) United States Patent
Boone

(10) Patent No.: US 11,761,321 B2
(45) Date of Patent: Sep. 19, 2023

(54) CONTROLLING OPERATING PARAMETERS OF A SURFACE DRILLING RIG TO OPTIMIZE BOTTOM-HOLE ASSEMBLY ("BHA") DRILLING PERFORMANCE

(71) Applicant: Nabors Drilling Technologies USA, Inc., Houston, TX (US)

(72) Inventor: Scott Boone, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 179 days.

(21) Appl. No.: 17/352,575

(22) Filed: Jun. 21, 2021

(65) Prior Publication Data

US 2022/0403730 A1 Dec. 22, 2022

(51) Int. Cl.
*E21B 44/06* (2006.01)
*E21B 47/024* (2006.01)

(52) U.S. Cl.
CPC ..... *E21B 44/06* (2013.01); *E21B 47/024* (2013.01)

(58) Field of Classification Search
CPC ..... E21B 44/06; E21B 47/024
See application file for complete search history.

(56) References Cited

U.S. PATENT DOCUMENTS

2019/0178073 A1* 6/2019 Boone ..... E21B 3/022
2022/0170323 A1* 6/2022 Hawkinson ..... E21B 7/04

* cited by examiner

*Primary Examiner* — Dany E Akakpo
(74) *Attorney, Agent, or Firm* — Haynes and Boone, LLP

(57) ABSTRACT

Method(s) and apparatus according to which: a bottom-hole assembly ("BHA") and a drilling rig together attempt to drill a wellbore segment along a planned trajectory while a test scenario is executed on the drilling rig by varying operating parameter(s) of the drilling rig in a predetermined manner during a predetermined time interval; performance characteristic(s) monitored by sensor(s) of the BHA during the predetermined time interval are then received; the predetermined manner in which the operating parameter(s) of the drilling rig were varied during the predetermined time interval is/are then compared to the received performance characteristic(s) monitored by the sensor(s) of the BHA during the predetermined time interval; and based on said comparison, the operating parameter(s) of a drilling rig (e.g., another drilling rig) are controlled while a BHA (e.g., another BHA) operably associated with the drilling rig attempts to drill a wellbore segment along a similar planned trajectory.

12 Claims, 9 Drawing Sheets

CONTROLLING OPERATING PARAMETERS OF A SURFACE DRILLING RIG TO OPTIMIZE BOTTOM-HOLE ASSEMBLY ("BHA") DRILLING PERFORMANCE

TECHNICAL FIELD

This application relates generally to drilling oil and gas wellbores and, more particularly, to controlling the operating parameters of a surface drilling rig to optimize bottom-hole assembly ("BHA") drilling performance.

BACKGROUND

A bottom-hole assembly ("BHA") adapted for directional drilling (of the rotary steerable ("RSS")-type or bent sub-type) is designed to run semi-autonomously, steering in a controlled manner regardless of drilling conditions produced by the operably-associated surface drilling rig. Since the BHA is required to take what is given by the surface drilling rig (e.g., revolutions-per-minute ("RPM") of the drill string, weight on bit ("WOB"), differential pressure ("DP"), etc.), it is often difficult to analyze and correct when the BHA performs unsatisfactorily according to a wellbore trajectory plan, resulting in suboptimal results. Therefore, what is needed are apparatus, system(s), and/or method(s) to address one or more of the foregoing issues, and/or one or more other issues.

BRIEF DESCRIPTION

DETAILED DESCRIPTION

Figure 1:
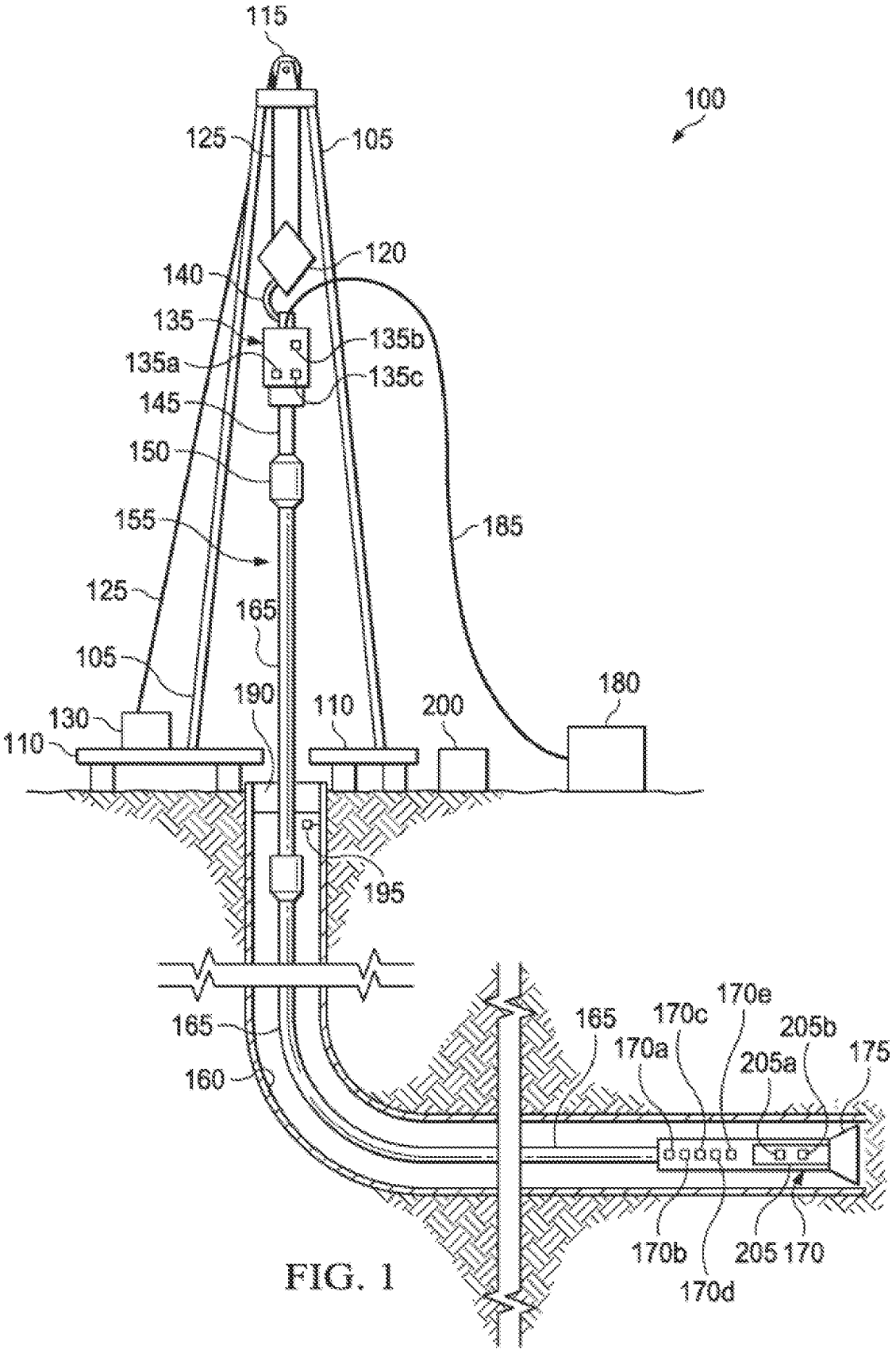
FIG. 1 is a schematic elevational view of a well system, according to one or more embodiments of the present disclosure.

The present disclosure describes running automated test scenario(s) on a surface drilling rig while a bottom-hole assembly ("BHA") adapted for directional drilling (e.g., a rotary steerable-type system, a bent sub-type system, etc.) downhole attempts to drill a wellbore along a planned wellbore trajectory. To determine which test scenario(s) produces the best results, performance characteristic(s) of the BHA are monitored by sensor(s) of the BHA while the test scenario(s) are run by the surface drilling rig. More particularly, the test scenario(s) involve varying operating parameter(s) of the surface drilling rig while the BHA monitors which test scenario(s) produce(s) the best results downhole. Performance characteristics monitored by the BHA may include, but are not limited to, steering control, shock and vibration, heat, build rate, etc. These performance characteristics from downhole, combined with knowledge of the recipes and procedures used by the surface drilling rig, dramatically improve the decision-making process for drilling optimization.

The automated test scenario(s) (which may also be referred to as "script(s)") run on the surface drilling rig may include but is/are not limited to automated drill off tests during the drilling of a test interval. For example, as weight on bit ("WOB") is fixed and revolutions-per-minute ("RPMs") of the drill string is varied, the BHA knows what the surface drilling rig is doing, monitors the performance characteristics produced downhole, and makes this data available to the surface. For another example, the next test scenario would hold RPMs of the drill string constant while varying WOB in a controlled manner to determine the impact (if any) of the BHA's performance characteristics. The same exercise is then performed with pump rate, etc. The results of these test scenarios are then used to help surface personnel optimize drilling performance by controlling the surface drilling rig based on the results of previous test scenarios when a similar planned drilling trajectory is next encountered. The same exercise can also performed with various operating parameters of the top drive controls. For example, proportional gain ("KF"; or stiffness) is held constant while integral gain ("CF"; integral gain, capacitance, or time delay) is swept through a range to determine the impact on BHA performance characteristics (e.g., time on target toolface, time on target WOB, time in target DP, etc.). For another example, the CF is then held constant and KF is swept through a range to determine the impact on BHA performance characteristics. Other test scenario(s) may include, but are not limited to, variations of tuning parameters for stick slip. Additionally, other performance characteristic(s) monitored by the BHA may include, but is/are not limited to: stick/slip; excessive vibrations; tool damaging vibration; excessive torques (e.g., exceeding the operating specification of the BHA); ability to maintain toolface; ability to maintain build rate; ability to increase/drop inclination or azimuth; etc.

Referring to FIG. 1, in an embodiment, a well system (e.g., a drilling rig) for implementing one or more embodiments of the present disclosure is schematically illustrated and generally referred to by the reference numeral 100. The well system 100 is or includes a land-based drilling rig—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The well system 100 includes a mast 105 that supports lifting gear above a rig floor 110, which lifting gear includes a crown block 115 and a traveling block 120. The crown block 115 is coupled to the mast 105 at or near the top of the mast 105. The traveling block 120 hangs from the crown block 115 by a drilling line 125. The drilling line 125 extends at one end from the lifting gear to drawworks 130, which drawworks 130 are configured to reel out and reel in the drilling line 125 to cause the traveling block 120 to be lowered and raised relative to the rig floor 110. The other end of the drilling line 125 (known as a dead line anchor) is anchored to a fixed position, possibly near the drawworks 130 (or elsewhere on the rig).

The well system 100 further includes a top drive 135, a hook 140, a quill 145, a saver sub 150, and a drill string 155. The top drive 135 is suspended from the hook 140, which hook is attached to the bottom of the traveling block 120. The quill 145 extends from the top drive 135 and is attached to a saver sub 150, which saver sub is attached to the drill string 155. The drill string 155 is thus suspended within a wellbore 160. The quill 145 may instead be attached directly to the drill string 155. The term "quill" as used herein is not limited to a component which directly extends from the top drive 135, or which is otherwise conventionally referred to as a quill 145. For example, within the scope of the present disclosure, the "quill" may additionally (or alternatively) include a main shaft, a drive shaft, an output shaft, and/or another component which transfers torque, position, and/or rotation from the top drive 135 or other rotary driving element to the drill string 155, at least indirectly. Nonetheless, albeit merely for the sake of clarity and conciseness, these components may be collectively referred to herein as the "quill."

The drill string 155 includes interconnected sections of drill pipe 165, a bottom-hole assembly ("BHA") 170, and a drill bit 175. The BHA 170 may include stabilizers, drill collars, and/or measurement-while-drilling ("MWD") or wireline conveyed instruments, among other components. The drill bit 175 is connected to the bottom of the BHA 170 or is otherwise attached to the drill string 155. One or more mud pumps 180 deliver drilling fluid to the drill string 155 through a hose or other conduit 185, which conduit may be connected to the top drive 135. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted in real-time or delayed time to the surface. Data transmission methods may include, for example, digitally encoding data and transmitting the encoded data to the surface as pressure pulses in the drilling fluid or mud system. The MWD tools and/or other portions of the BHA 170 may have the ability to store measurements for later retrieval via wireline and/or when the BHA 170 is tripped out of the wellbore 160.

The well system 100 may also include a rotating blow-out preventer ("BOP") 190, such as if the wellbore 160 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 190. The well system 100 may also include a surface casing annular pressure sensor 195 configured to detect the pressure in the annulus defined between, for example, the wellbore 160 (or casing therein) and the drill string 155. In the embodiment of FIG. 1, the top drive 135 is utilized to impart rotary motion to the drill string 155. However, aspects of the present disclosure are also applicable or readily adaptable to embodiments utilizing other drive systems, such as a power swivel, a rotary table, a coiled tubing unit, a downhole motor, and/or a conventional rotary rig, among others.

The well system 100 also includes a control system 200 configured to control or assist in the control of one or more components of the well system 100—for example, the control system 200 may be configured to transmit operational control signals to the drawworks 130, the top drive 135, the BHA 170 and/or the mud pump(s) 180. The control system 200 may be a stand-alone component installed near the mast 105 and/or other components of the well system 100. In several embodiments, the control system 200 includes one or more systems located in a control room proximate the well system 100, such as the general purpose shelter often referred to as the "doghouse" serving as a combination tool shed, office, communications center, and general meeting place. The control system 200 may be configured to transmit the operational control signals to the drawworks 130, the top drive 135, the BHA 170, and/or the mud pump(s) 180 via wired or wireless transmission. The control system 200 may also be configured to receive electronic signals via wired or wireless transmission from a variety of sensors included in the well system 100, where each sensor is configured to detect an operational characteristic or parameter. The sensors from which the control system 200 is configured to receive electronic signals via wired or wireless transmission may be, include, or be part of one or more of the following: a torque sensor 135*a*, a speed sensor 135*b*, a WOB sensor 135*c*, downhole pressure sensor(s) 170*a*, a shock/vibration sensor 170*b*, a toolface sensor 170*c*, a WOB sensor 170*d*, an MWD survey tool 170*e*, the surface casing annular pressure sensor 195, a mud motor delta pressure ("ΔP") sensor 205*a*, and one or more torque sensors 205*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the well system 100.

The well system 100 may include any combination of the following: the torque sensor 135*a*, the speed sensor 135*b*, and the WOB sensor 135*c*. The torque sensor 135*a* is coupled to or otherwise associated with the top drive 135—however, the torque sensor 135*a* may alternatively be part of or associated with the BHA 170. The torque sensor 135*a* is configured to detect a value (or range) of the torsion of the quill 145 and/or the drill string 155 in response to, for example, operational forces acting on the drill string 155. The speed sensor 135*b* is configured to detect a value (or range) of the rotational speed of the quill 145. The WOB sensor 135*c* is coupled to or otherwise associated with the top drive 135, the drawworks 130, the crown block 115, the traveling block 120, the drilling line 125 (which includes the dead line anchor), or another component in the load path mechanisms of the well system 100. More particularly, the WOB sensor 135*c* includes one or more sensors different from the WOB sensor 170*d* that detect and calculate weight-on-bit, which can vary from rig to rig (e.g., calculated from a hook load sensor based on active and static hook load).

Further, the well system 100 may additionally (or alternatively) include any combination of the following: the downhole pressure sensor(s) 170*a*, the shock/vibration sensor 170*b*, the toolface sensor 170*c*, and the WOB sensor 170*d*. The downhole pressure sensor(s) 170*a* is/are coupled to or otherwise associated with the BHA 170. One or more of the downhole pressure sensor(s) 170*a* may be configured to detect a pressure value or range in the annulus-shaped region defined between the external surface of the BHA 170 and the internal diameter of the wellbore 160 (also referred to as the casing pressure, downhole casing pressure, MWD casing pressure, or downhole annular pressure); such measurements may include both static annular pressure (i.e., when the mud pump(s) 180 are off) and active annular pressure (i.e., when the mud pump(s) 180 are on). In addition, or instead, one or more of the downhole pressure sensor(s) 170*a* may be configured to detect a pressure value or range internal to the drill pipe 165 and/or the BHA 170 (also referred to as the downhole drill string pressure); such measurements may include both static drill string pressure (i.e., when the mud pump(s) 180 are off) and active drill string pressure (i.e., when the mud pump(s) 180 are on). The shock/vibration sensor 170*b* is configured for detecting shock and/or vibration in the BHA 170. The toolface sensor 170*c* is configured to detect the current toolface orientation of the drill bit 175, and may be or include a magnetic toolface sensor which detects toolface orientation relative to magnetic north or true north. In addition, or instead, the toolface sensor 170*c* may be or include a gravity toolface sensor which detects toolface orientation relative to the Earth's gravitational field. In addition, or instead, the toolface sensor 170*c* may be or include a gyro sensor. The WOB sensor 170*d* may be integral to the BHA 170 and is configured to detect WOB at or near the BHA 170.

Further still, the well system 100 may additionally (or alternatively) include the MWD survey tool 170*e* at or near the BHA 170. In several embodiments, the MWD survey tool 170*e* may include any of the sensors 170*a*-170*d* or any combination of these sensors. The BHA 170 and the MWD portion of the BHA 170 (which portion includes the sensors 170*a-d* and the MWD survey tool 170*e*) may be collectively referred to as a "downhole tool." Alternatively, the BHA 170 and the MWD portion of the BHA 170 may each be individually referred to as a "downhole tool." The MWD survey tool 170*e* may be configured to perform surveys along lengths of a wellbore, such as during drilling and tripping operations. The data from these surveys may be transmitted by the MWD survey tool 170*e* to the control system 200 through various telemetry methods, such as mud pulses. In addition, or instead, the data from the surveys may be stored within the MWD survey tool 170*e* or an associated memory. In such embodiments, the survey data may be downloaded to the control system 200 when the MWD survey tool 170*e* is removed from the wellbore or at a maintenance facility at a later time.

Finally, the well system 100 may additionally (or alternatively) include any combination of the following: the mud motor ΔP sensor 205*a* and the torque sensor(s) 205*b*. The mud motor ΔP sensor 205*a* is configured to detect a pressure differential value or range across one or more motors 205 of the BHA 170 and may comprise one or more individual pressure sensors and/or a comparison tool. The motor(s) 205 may each be or include a positive displacement drilling motor that uses hydraulic power of the drilling fluid to drive the drill bit 175 (also known as a mud motor). The torque sensor(s) 205*b* may also be included in the BHA 170 for sending data to the control system 200 that is indicative of the torque applied to the drill bit 175 by the motor(s) 205.

Figure 2:
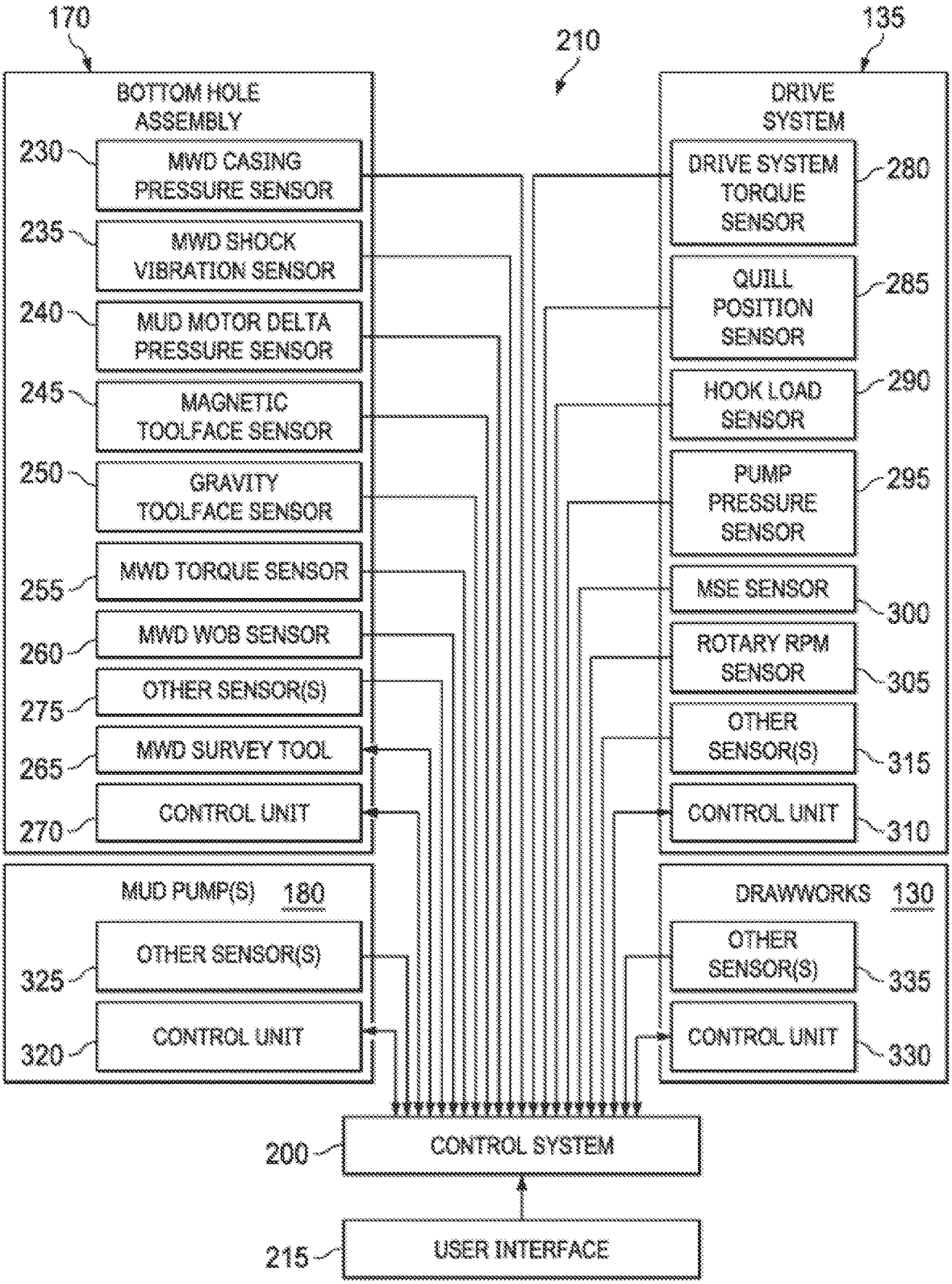
FIG. 2 is a diagrammatic view of a well system that may be, include, or be part of the well system of FIG. 1, according to one or more embodiments of the present disclosure.

Referring to FIG. 2, in an embodiment, a well system is generally referred to by the reference numeral 210 and includes one or more components of the well system 100. More particularly, the well system 210 may include at least respective parts of the well system 100, including, but not limited to, the control system 200, the drawworks 130, the top drive 135 (identified as a "drive system" in FIG. 2), the BHA 170, and the mud pump(s) 180. The well system 210 may be implemented within the environment and/or the well system 100 of FIG. 1. As such, the well system 100 and/or the well system 210 may be individually or collectively referred to as a "well system," a "drilling system," a "drilling rig," or the like. As shown in FIG. 2, the control system 200 includes a user-interface 215 adapted to communicate therewith—depending on the embodiment, the control system 200 and the user-interface 215 may be discrete components that are interconnected via a wired or wireless link. The user-interface 215 and the control system 200 may additionally (or alternatively) be integral components of a single system.

Figure 3:
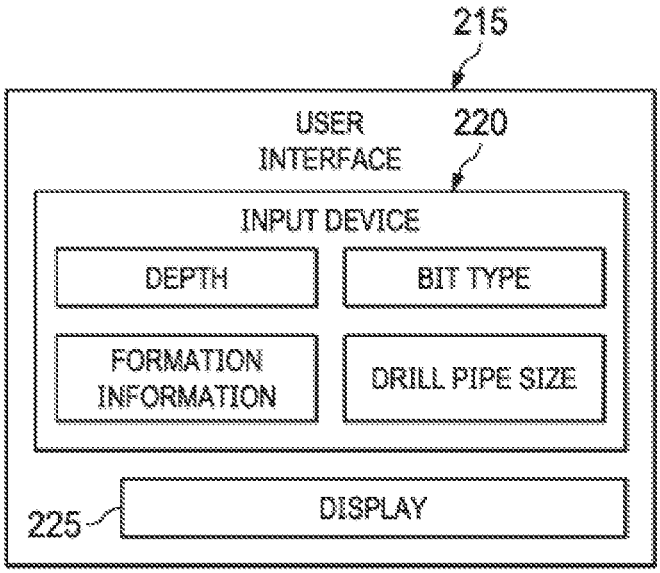
FIG. 3 is a diagrammatic view of a user interface of the well system of FIG. 2, according to one or more embodiments of the present disclosure.

Referring to FIG. 3, in an embodiment, the user-interface 215 includes an input mechanism 220 that permits a user to input drilling settings or parameters such as, for example, left and right oscillation revolution settings (these settings control the drive system to oscillate a portion of the drill string 155), acceleration, toolface setpoints, rotation settings, a torque target value (such as a previously calculated torque target value that may determine the limits of oscillation), information relating to the drilling parameters of the drill string 155 (such as BHA information or arrangement, drill pipe size, bit type, depth, and formation information), and/or other setpoints and input data. The input mechanism 220 may include a keypad, voice-recognition apparatus, dial, button, switch, slide selector, toggle, joystick, mouse, database, and/or any other suitable data input device. The input mechanism 220 may support data input from local and/or remote locations. In addition, or instead, the input mechanism 220, when included, may permit user-selection of predetermined profiles, algorithms, setpoint values or ranges, such as via one or more drop-down menus—this data may instead (or in addition) be selected by the control system 200 via the execution of one or more database look-up procedures. In general, the input mechanism 220 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 215 may also include a display unit 225 for visually presenting information to the user in textual, graphic, or video form. The display unit 225 may be utilized by the user to input drilling parameters, limits, or setpoint data in conjunction with the input mechanism 220—for example, the input mechanism 220 may be integral to or otherwise communicably coupled with the display unit 225. The control system 200 may be configured to receive data or information from the user, the drawworks 130, the top drive 135, the BHA 170, and/or the mud pump(s) 180—the control system 200 processes such data or information to enable effective and efficient drilling.

Referring back to FIG. 2, in an embodiment, the BHA 170 includes one or more sensors (typically a plurality of sensors) located and configured about the BHA 170 to detect parameters relating to the drilling environment, the condition and orientation of the BHA 170, and/or other information. For example, the BHA 170 may include an MWD casing pressure sensor 230, an MWD shock/vibration sensor 235, a mud motor ΔP sensor 240, a magnetic toolface sensor 245, a gravity toolface sensor 250, an MWD torque sensor 255, and an MWD weight-on-bit ("WOB") sensor 260—in several embodiments, one or more of these sensors is, includes, or is part of the following sensor(s) shown in FIG. 1: the downhole pressure sensor(s) 170*a*, the shock/vibration sensor 170*b*, the toolface sensor 170*c*, the WOB sensor 170*d*, the mud motor ΔP sensor 205*a*, and/or the torque sensor(s) 205*b*.

The MWD casing pressure sensor 230 is configured to detect an annular pressure value or range at or near the MWD portion of the BHA 170. The MWD shock/vibration sensor 235 is configured to detect shock and/or vibration in the MWD portion of the BHA 170. The mud motor ΔP sensor 240 is configured to detect a pressure differential value or range across the mud motor of the BHA 170. The magnetic toolface sensor 245 and the gravity toolface sensor 250 are cooperatively configured to detect the current toolface orientation. In several embodiments, the magnetic toolface sensor 245 is or includes a magnetic toolface sensor that detects toolface orientation relative to magnetic north or true north. In several embodiments, the gravity toolface sensor 250 is or includes a gravity toolface sensor that detects toolface orientation relative to the Earth's gravitational field. In several embodiments, the magnetic toolface sensor 245 detects the current toolface when the end of the wellbore 160 is less than about 7° from vertical, and the gravity toolface sensor 250 detects the current toolface when the end of the wellbore 160 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 255 is configured to detect a value or range of values for torque applied to the bit by the motor(s) of the BHA 170. The MWD weight-on-bit ("WOB") sensor 260 is configured to detect a value (or range of values) for WOB at or near the BHA 170.

The following data may be sent to the control system 200 via one or more signals, such as, for example, electronic signal via wired or wireless transmission, mud-pulse telemetry, another signal, or any combination thereof: the casing pressure data detected by the MWD casing pressure sensor 230, the shock/vibration data detected by the MWD shock/vibration sensor 235, the pressure differential data detected by the mud motor ΔP sensor 240, the toolface orientation data detected by the toolface sensors 245 and 250, the torque data detected by the MWD torque sensor 255, and/or the WOB data detected by the MWD WOB sensor 260. The pressure differential data detected by the mud motor ΔP sensor 240 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The BHA 170 may also include an MWD survey tool 265—in several embodiments, the MWD survey tool 265 is, includes, or is part of the MWD survey tool 170*e* shown in FIG. 1. The MWD survey tool 265 may be configured to perform surveys at intervals along the wellbore 160, such as during drilling and tripping operations. The MWD survey tool 265 may include one or more gamma ray sensors that detect gamma data. The data from these surveys may be transmitted by the MWD survey tool 265 to the control system 200 through various telemetry methods, such as mud pulse telemetry, electromagnetic telemetry, acoustic telemetry, the like, or any combination thereof. In other embodiments, survey data is collected and stored by the MWD survey tool 265 in an associated memory. This data may be uploaded to the control system 200 at a later time, such as when the MWD survey tool 265 is removed from the wellbore 160 or during maintenance. Some embodiments use alternative data gathering sensors or obtain information from other sources. For example, the BHA 170 may include sensors for making additional measurements, including, for example and without limitation, azimuthal gamma data, neutron density, porosity, and resistivity of surrounding formations. In several embodiments, such information may be obtained from third parties or may be measured by systems other than the BHA 170.

The BHA 170 may include a memory and a transmitter. In several embodiments, the memory and transmitter are integral parts of the MWD survey tool 265, while in other embodiments, the memory and transmitter are separate and distinct modules. The memory may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory may be configured to store readings and measurements for some period of time. In several embodiments, the memory is configured to store the results of surveys performed by the MWD survey tool 265 for some period of time, such as the time between drilling connections, or until the memory may be downloaded after a tripping out operation. The transmitter may be any type of device to transmit data from the BHA 170 to the control system 200, and may include a mud pulse transmitter. In several embodiments, the MWD survey tool 265 is configured to transmit survey results in real-time to the surface through the transmitter. In other embodiments, the MWD survey tool 265 is configured to store survey results in the memory for a period of time, access the survey results from the memory, and transmit the results to the control system 200 through the transmitter.

In several embodiments, the BHA 170 also includes a control unit 270 for controlling the rotational position, speed, and direction of the rotary drilling bit or toolface. The control unit 270 may be, include, or be part of the control system 200, or another control system. The BHA 170 may also include other sensor(s) 275 such as, for example, other MWD sensors, other LWD sensors, other downhole sensors, back-up/redundant sensors, one or more sensors repurposed, repositioned, or reproduced from one or more of the top drive 135, the drawworks 130, and/or the mud pump(s) 180, and/or or any combination thereof.

The top drive 135 includes one or more sensors (typically a plurality of sensors) located and configured about the top drive 135 to detect parameters relating to the condition and orientation of the drill string 155, and/or other information. For example, the top drive 135 may include a rotary torque sensor 280, a quill position sensor 285, a hook load sensor 290, a pump pressure sensor 295, a mechanical specific energy ("MSE") sensor 300, and a rotary RPM sensor 305—in several embodiments, one or more of these sensors is, includes, or is part of the following sensor(s) shown in FIG. 1: the torque sensor 135*a*, the speed sensor 135*b*, the WOB sensor 135*c*, and/or the casing annular pressure sensor 195. In addition to, or instead of, being included as part of the drive system 135, the pump pressure sensor 295 may be included as part of the mud pump(s) 180. In several embodiments, the top drive 135 also includes a control unit 310 for controlling the rotational position, speed, and direction of the quill 145 and/or another component of the drill string 155 coupled to the top drive 135. The control unit 310 may be, include, or be part of the control system 200, or another control system. The top drive 135 may also include other sensor(s) 315 such as, for example, other top drive sensors, other surface sensors, back-up/redundant sensors, one or more sensors repurposed, repositioned, or reproduced from one or more of the BHA 170, the drawworks 130, and/or the mud pump(s) 180, and/or or any combination thereof.

The rotary torque sensor 280 is configured to detect a value (or range of values) for the reactive torsion of the quill 145 or the drill string 155. The quill position sensor 285 is configured to detect a value (or range of values) for the rotational position of the quill 145 (e.g., relative to true north or another stationary reference). The hook load sensor 290 is configured to detect the load on the hook 140 as it suspends the top drive 135 and the drill string 155. The pump pressure sensor 295 is configured to detect the pressure of the mud pump(s) 180 providing mud or otherwise powering the BHA 170 from the surface. In several embodiments, rather than being included as part of the top drive 135, the pump pressure sensor 295 may be incorporated into, or included as part of, the mud pump(s) 180. The MSE sensor 300 is configured to detect the MSE representing the amount of energy required per unit volume of drilled rock—in several embodiments, the MSE is not directly detected, but is instead calculated at the control system 200 (or another control system or control unit) based on sensed data. The rotary RPM sensor 305 is configured to detect the rotary RPM of the drill string 155—this may be measured at the top drive 135 or elsewhere (e.g., at surface portion of the drill string 155). The following data may be sent to the control system 200 via one or more signals, such as, for example, electronic signal via wired or wireless transmission: the rotary torque data detected by the rotary torque sensor 280, the quill position data detected by the quill position sensor 285, the hook load data detected by the hook load sensor 290, the pump pressure data detected by the pump pressure sensor 295, the MSE data detected (or calculated) by the MSE sensor 300, and/or the RPM data detected by the RPM sensor 305.

The mud pump(s) 180 may include a control unit 320 and/or other means for controlling the pressure and flow rate of the drilling mud produced by the mud pump(s) 180—such control may include torque and speed control of the mud pump(s) 180 to manipulate the pressure and flow rate of the drilling mud and the ramp-up or ramp-down rates of the mud pump(s) 180. In several embodiments, the control unit 320 is, includes, or is part of the control system 200. The mud pump(s) 180 may also include other sensor(s) 325 such as, for example, the pump pressure sensor 295, one or more pump flow sensors, other mud pump sensors, other surface sensors, back-up/redundant sensors, one or more sensors repurposed, repositioned, or reproduced from one or more of the BHA 170, the top drive 135, and/or the drawworks 130, and/or or any combination thereof.

The drawworks 130 may include a control unit 330 and/or other means for controlling feed-out and/or feed-in of the drilling line 125 (shown in FIG. 1)—such control may include rotational control of the drawworks to manipulate the height or position of the hook and the rate at which the hook ascends or descends. The drill string feed-off system of the drawworks 130 may instead be a hydraulic ram or rack and pinion type hoisting system rig, where the movement of the drill string 155 up and down is facilitated by something other than a drawworks. The drill string 155 may also take the form of coiled tubing, in which case the movement of the drill string 155 in and out of the wellbore 160 is controlled by an injector head which grips and pushes/pulls the tubing in/out of the wellbore 160. Such embodiments still include a version of the control unit 330 configured to control feed-out and/or feed-in of the drill string 155. In several embodiments, the control unit 330 is, includes, or is part of the control system 200. The drawworks 130 may also include other sensor(s) 335 such as, for example, other drawworks sensors, other surface sensors, back-up/redundant sensors, one or more sensors repurposed, repositioned, or reproduced from one or more of the BHA 170, the top drive 135, and/or the drawworks 130, and/or or any combination thereof.

The control system 200 may be configured to receive data or information relating to one or more of the above-described parameters from the user-interface 215, the BHA 170 (including the MWD survey tool 265), the top drive 135, the mud pump(s) 180, and/or the drawworks 130, as described above, and to utilize such information to enable effective and efficient drilling. In several embodiments, the parameters are transmitted to the control system 200 by one or more data channels. In several embodiments, each data channel may carry data or information relating to a particular sensor or combination of sensors. The control system 200 may be further configured to generate a control signal, such as via intelligent adaptive control, and provide the control signal to the top drive 135, the mud pump(s) 180, the drawworks 130, and/or the BHA 170 to adjust and/or maintain one or more of the following: the rotational position, speed, and direction of the quill 145 and/or another component of the drill string 155 coupled to the top drive 135, the pressure and flow rate of the drilling mud produced by the mud pump(s) 180, the feed-out and/or feed-in of the drilling line 125, and/or the rotational position, speed, and direction of the rotary drilling bit or toolface. Moreover, one or more of the control unit 270 of the BHA 170 the control unit 310 of the top drive 135, the control unit 320 of the mud pump(s) 180, and/or the control unit 330 of the drawworks 130 may be configured to generate and transmit signals to the control system 200—these signals influence the control of the BHA 170, the top drive 135, the mud pump(s) 180, and/or the drawworks 130. In addition, or instead, any one of the control units 270, 310, 320, and 330 may be configured to generate and transmit signals to another one of the control units 270, 310, 320, or 330, whether directly or via the control system 200—as a result, any combination of the control units 270, 310, 320, and 330 may be configured to cooperate in controlling the BHA 170, the top drive 135, the mud pump(s) 180, and/or the drawworks 130.

Figure 4A:
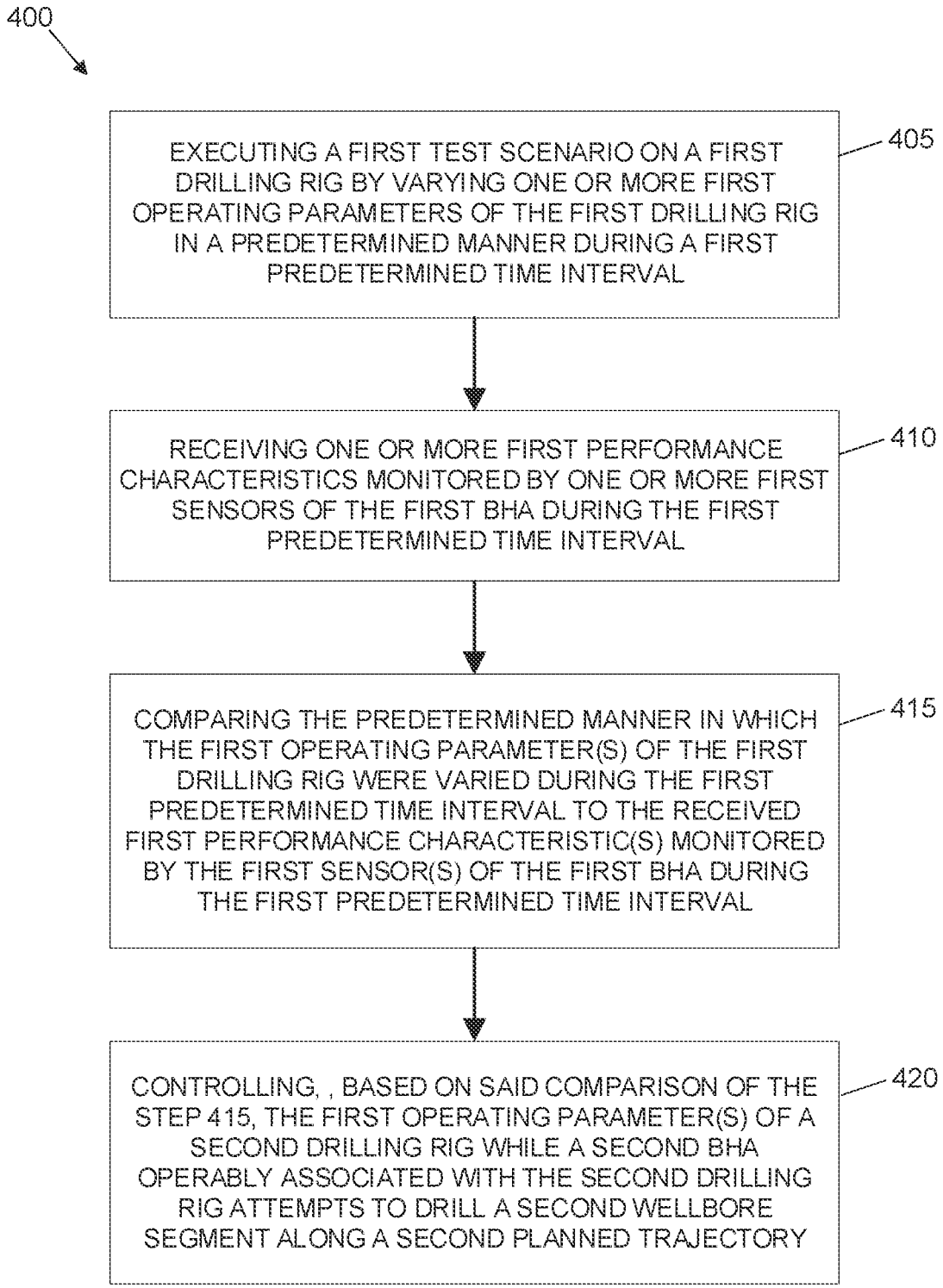
FIG. 4A is a flow diagram of a method for implementing one or more embodiments of the present disclosure.

Referring to FIGS. 4A through 4E, in an embodiment, a method is generally referred to by the reference numeral 400. As shown in FIG. 4A, in one or more embodiments, the method 400 includes steps 405, 410, 415, and 420. At the step 405, a first test scenario is executed on a first drilling rig by varying one or more first operating parameters of the first drilling rig in a predetermined manner during a first predetermined time interval. In one or more embodiments, the step 405 is executed while a first BHA and the first drilling rig together attempt to drill a first wellbore segment along a first planned trajectory. In one or more embodiments, the first BHA and the first drilling rig together attempt to drill the first wellbore segment along the first planned trajectory by: moving, using the first drilling rig, a tubular string extending from the first drilling rig, into a wellbore, and to the first BHA; circulating, using the first drilling rig, a drilling fluid through wellbore via the tubular string; and drilling, using the first BHA, to extend the wellbore. At the step 410, one or more first performance characteristics monitored by one or more first sensors of the first BHA during the first predetermined time interval is/are received. At the step 415, the predetermined manner in which the first operating parameter(s) of the first drilling rig were varied during the first predetermined time interval is/are compared to the received first performance characteristic(s) monitored by the first sensor(s) of the first BHA during the first predetermined time interval. At the step 420, the first operating parameter(s) of a second drilling rig is/are controlled, based on said comparison of the step 415, while a second BHA operably associated with the second drilling rig attempts to drill a second wellbore segment along a second planned trajectory. In one or more embodiments, the first and second drilling rigs are the same drilling rig; the first and second BHAs are the same BHA; and the first and second wellbore segments are part of the same wellbore.

Figure 4B:
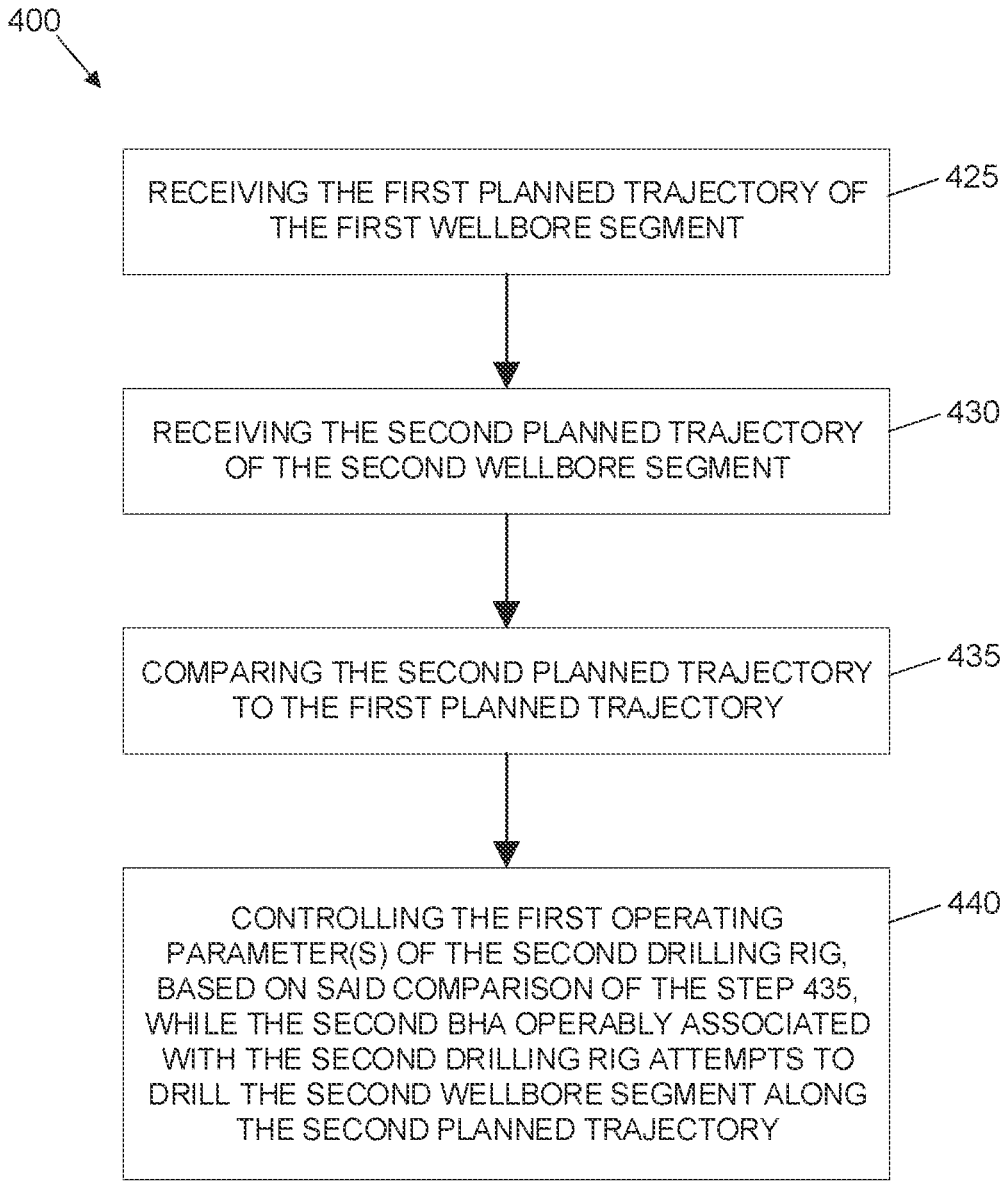
FIG. 4B is a flow diagram of optional additional steps of the method of FIG. 4A for implementing one or more embodiments of the present disclosure.

As shown in FIG. 4B, in one or more embodiments, the method 400 includes steps 425, 430, 435, and 440. At the step 425, the first planned trajectory of the first wellbore segment is received. At the step 430, the second planned trajectory of the second wellbore segment is received. At the step 435, the second planned trajectory is compared to the first planned trajectory. At the step 440, the first operating parameter(s) of the second drilling rig is/are controlled, based on said comparison of the step 435, while the second BHA operably associated with the second drilling rig attempts to drill the second wellbore segment along the second planned trajectory.

Figure 4C:
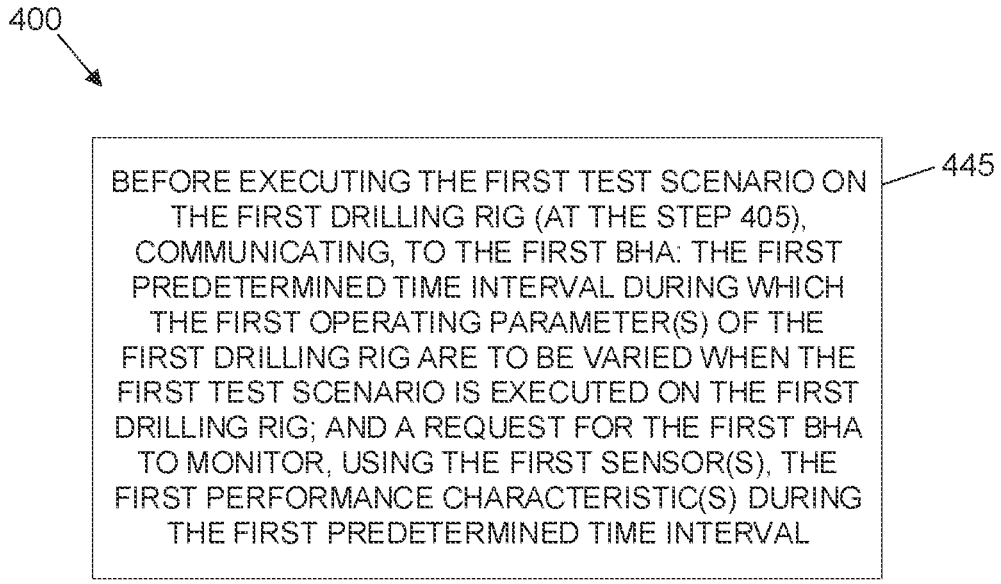
FIG. 4C is a flow diagram of an optional additional step of the method of FIGS. 4A and 4B for implementing one or more embodiments of the present disclosure.

As shown in FIG. 4C, in one or more embodiments, the method 400 includes step 445. At the step 445, the following data/information is communicated to the first BHA before executing the first test scenario on the first drilling rig (at the step 405): the first predetermined time interval during which the first operating parameter(s) of the first drilling rig are to be varied when the first test scenario is executed on the first drilling rig; and a request for the first BHA to monitor, using the first sensor(s), the first performance characteristic(s) during the first predetermined time interval.

Figure 4D:
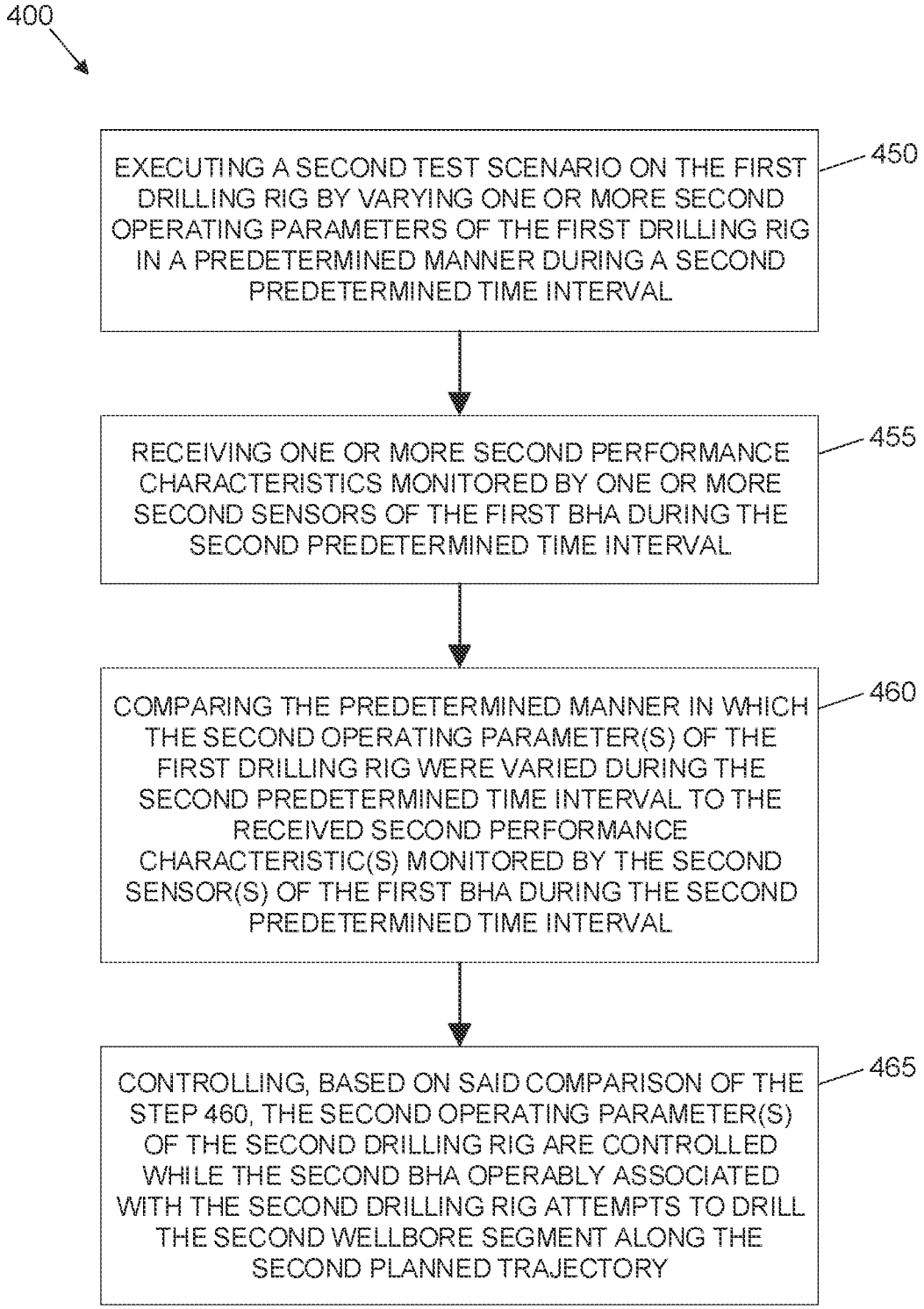
FIG. 4D is a flow diagram of optional additional steps of the method of FIGS. 4A through 4C for implementing one or more embodiments of the present disclosure.

As shown in FIG. 4D, in one or more embodiments, the method 400 includes steps 450, 455, 460, and 465. At the step 450, a second test scenario is executed on the first drilling rig by varying one or more second operating parameters of the first drilling rig in a predetermined manner during a second predetermined time interval. In one or more embodiments, the step 450 is executed while the first BHA and the first drilling rig together attempt to drill the first wellbore segment along the first planned trajectory. At the step 455, one or more second performance characteristics monitored by one or more second sensors of the first BHA during the second predetermined time interval is/are received. At the step 460, the predetermined manner in which the second operating parameter(s) of the first drilling rig were varied during the second predetermined time interval is/are compared to the received second performance characteristic(s) monitored by the second sensor(s) of the first BHA during the second predetermined time interval. At the step 465, the second operating parameter(s) of the second drilling rig are controlled, based on said comparison of the step 460, while the second BHA operably associated with the second drilling rig attempts to drill the second wellbore segment along the second planned trajectory. In one or more embodiments, at least one of the first sensor(s) of the first BHA and at least one of the second sensor(s) of the first BHA are the same sensor(s). In one or more embodiments, at least one of the first performance characteristic(s) and at least one of the second performance characteristic(s) are the same performance characteristic(s). In one or more embodiments, at least one of the first operating parameter(s) and at least one of the second operating parameter(s) are the same operating parameter(s).

Figure 4E:
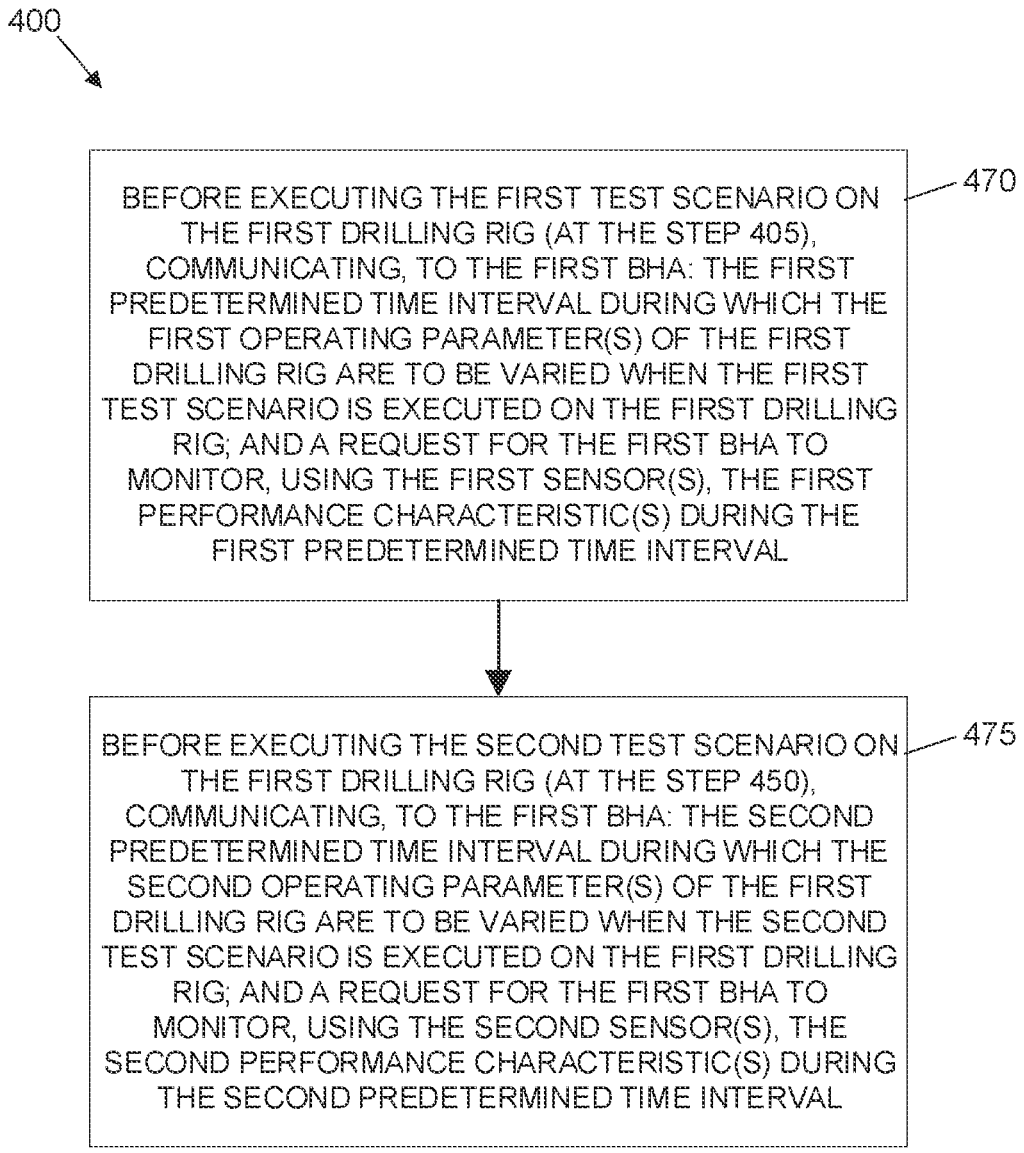
FIG. 4E is a flow diagram of optional additional steps of the method of FIGS. 4A through 4D for implementing one or more embodiments of the present disclosure.

As shown in FIG. 4E, in one or more embodiments, the method 400 includes steps 470 and 475. At the step 470, the following data/information is communicated to the first BHA before executing the first test scenario on the first drilling rig (at the step 405): the first predetermined time interval during which the first operating parameter(s) of the first drilling rig are to be varied when the first test scenario is executed on the first drilling rig; and a request for the first BHA to monitor, using the first sensor(s), the first performance characteristic(s) during the first predetermined time interval. At the step 475, the following data/information is communicated to the first BHA before executing the second test scenario on the first drilling rig (at the step 450): the second predetermined time interval during which the second operating parameter(s) of the first drilling rig are to be varied when the second test scenario is executed on the first drilling rig; and a request for the first BHA to monitor, using the second sensor(s), the second performance characteristic(s) during the second predetermined time interval.

Figure 5:
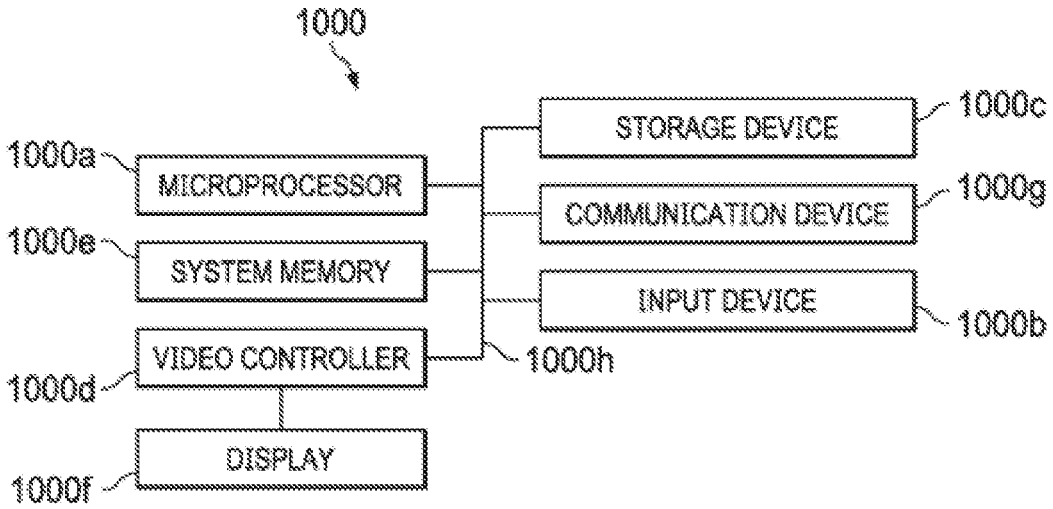
FIG. 5 is a diagrammatic illustration of a computing node for implementing one or more embodiments of the present disclosure.

Referring to FIG. 5, with continuing reference to FIGS. 1 through 4E, in one or more embodiments, a computing node 1000 for implementing one or more embodiments of one or more of the above-described element(s), component(s), system(s), apparatus, method(s), step(s), and/or control unit(s) (such as, for example, the control unit(s) shown and described in connection with FIG. 2), and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the microprocessor 1000*a* is, includes, or is part of, the control system 200 and/or the one or more other control units described herein in connection with FIG. 2. In one or more embodiments, the storage device 1000*c* may include a floppy drive, hard drive, CD-ROM, optical drive, any other form of storage device or any combination thereof. In one or more embodiments, the storage device 1000*c* may include, and/or be capable of receiving, a floppy disk, CD-ROM, DVD-ROM, or any other form of computer-readable medium that may contain executable instructions. In one or more embodiments, the communication device 1000*g* may include a modem, network card, or any other device to enable the node 1000 to communicate with other nodes. In one or more embodiments, any node represents a plurality of interconnected (whether by intranet or Internet) computer systems, including without limitation, personal computers, mainframes, PDAs, smartphones and cell phones.

In one or more embodiments, one or more of the components of any of the above-described systems include at least the node 1000 and/or components thereof, and/or one or more nodes that are substantially similar to the node 1000 and/or components thereof. In one or more embodiments, one or more of the above-described components of the node 1000 and/or the above-described systems include respective pluralities of same components.

In one or more embodiments, a computer system typically includes at least hardware capable of executing machine readable instructions, as well as the software for executing acts (typically machine-readable instructions) that produce a desired result. In one or more embodiments, a computer system may include hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In one or more embodiments, software functions may be directly manufactured into a silicon chip. Accordingly, combinations of hardware and software are also included within the definition of a computer system and are thus envisioned by the present disclosure as possible equivalent structures and equivalent methods.

In one or more embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable one or more embodiments of the present disclosure. In one or more embodiments, data structure may provide an organization of data, or an organization of executable code.

In one or more embodiments, any networks and/or one or more portions thereof, may be designed to work on any specific architecture. In one or more embodiments, one or more portions of any networks may be executed on a single computer, local area networks, client-server networks, wide area networks, internets, hand-held and other portable and wireless devices and networks.

In one or more embodiments, database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In one or more embodiments, the data contained in the location of a character file can be mapped to a field in a second table. In one or more embodiments, the physical location of the database is not limiting, and the database may be distributed. In one or more embodiments, the database may exist remotely from the server, and run on a separate platform. In one or more embodiments, the database may be accessible across the Internet. In one or more embodiments, more than one database may be implemented.

In one or more embodiments, a plurality of instructions stored on a non-transitory computer readable medium may be executed by one or more processors to cause the one or more processors to carry out or implement in whole or in part the above-described operation of each of the above-described element(s), component(s), system(s), apparatus, method(s), step(s), and/or control unit(s) (such as, for example, the control unit(s) shown and described in connection with FIG. 2), and/or any combination thereof. In one or more embodiments, such a processor may be or include one or more of the microprocessor 1000*a*, one or more control units (such as, for example, the control unit(s) shown and described in connection with FIGS. 2), one or more other controllers, any processor(s) that are part of the components of the above-described systems, and/or any combination thereof, and such a computer readable medium may be distributed among one or more components of the above-described systems. In one or more embodiments, such a processor may execute the plurality of instructions in connection with a virtual computer system. In one or more embodiments, such a plurality of instructions may communicate directly with the one or more processors, and/or may interact with one or more operating systems, middleware, firmware, other applications, and/or any combination thereof, to cause the one or more processors to execute the instructions.

A method has been disclosed. The method generally includes: while a first bottom-hole assembly ("BHA") and a first drilling rig together attempt to drill a first wellbore segment along a first planned trajectory, executing a first test scenario on the first drilling rig by varying one or more first operating parameters of the first drilling rig in a predetermined manner during a first predetermined time interval; receiving one or more first performance characteristics monitored by one or more first sensors of the first BHA during the first predetermined time interval; comparing the predetermined manner in which the first operating parameter(s) of the first drilling rig were varied during the first predetermined time interval to the received first performance characteristic(s) monitored by the first sensor(s) of the first BHA during the first predetermined time interval; and based on said comparison, controlling the first operating parameter(s) of a second drilling rig while a second BHA operably associated with the second drilling rig attempts to drill a second wellbore segment along a second planned trajectory. In one or more embodiments, the first and second drilling rigs are the same drilling rig; the first and second BHAs are the same BHA; and the first and second wellbore segments are part of the same wellbore. In one or more embodiments, the method further includes: receiving the first planned trajectory of the first wellbore segment; receiving the second planned trajectory of the second wellbore segment; comparing the second planned trajectory to the first planned trajectory; and based on said comparison, controlling the first operating parameter(s) of the second drilling rig while the second BHA operably associated with the second drilling rig attempts to drill the second wellbore segment along the second planned trajectory. In one or more embodiments, the method further includes: before executing the first test scenario on the first drilling rig, communicating, to the first BHA: the first predetermined time interval during which the first operating parameter(s) of the first drilling rig are to be varied when the first test scenario is executed on the first drilling rig; and a request for the first BHA to monitor, using the first sensor(s), the first performance characteristic(s) during the first predetermined time interval. In one or more embodiments, the method further includes: while the first BHA and the first drilling rig together attempt to drill the first wellbore segment along the first planned trajectory, executing a second test scenario on the first drilling rig by varying one or more second operating parameters of the first drilling rig in a predetermined manner during a second predetermined time interval; receiving one or more second performance characteristics monitored by one or more second sensors of the first BHA during the second predetermined time interval; comparing the predetermined manner in which the second operating parameter(s) of the first drilling rig were varied during the second predetermined time interval to the received second performance characteristic(s) monitored by the second sensor(s) of the first BHA during the second predetermined time interval; and based on said comparison, controlling the second operating parameter(s) of the second drilling rig while the second BHA operably associated with the second drilling rig attempts to drill the second wellbore segment along the second planned trajectory. In one or more embodiments, at least one of the first sensor(s) of the first BHA and at least one of the second sensor(s) of the first BHA are the same sensor(s). In one or more embodiments, at least one of the first performance characteristic(s) and at least one of the second performance characteristic(s) are the same performance characteristic(s). In one or more embodiments, at least one of the first operating parameter(s) and at least one of the second operating parameter(s) are the same operating parameter(s). In one or more embodiments, the method further includes: before executing the first and second test scenarios on the first drilling rig, communicating, to the first BHA: the first predetermined time interval during which the first operating parameter(s) of the first drilling rig are to be varied when the first test scenario is executed on the first drilling rig; a request for the first BHA to monitor, using the first sensor(s), the first performance characteristic(s) during the first predetermined time interval; the second predetermined time interval during which the second operating parameter(s) of the first drilling rig are to be varied when the second test scenario is executed on the first drilling rig; and a request for the first BHA to monitor, using the second sensor(s), the second performance characteristic(s) during the second predetermined time interval. In one or more embodiments, the first BHA and the first drilling rig together attempt to drill the first wellbore segment along the first planned trajectory by: moving, using the first drilling rig, a tubular string extending from the first drilling rig, into a wellbore, and to the first BHA; circulating, using the first drilling rig, a drilling fluid through wellbore via the tubular string; and drilling, using the first BHA, to extend the wellbore.

An apparatus has also been disclosed. The apparatus generally includes: a non-transitory computer readable medium; and a plurality of instructions stored on the non-transitory computer readable medium and executable by one or more processors, wherein, when the instructions are executed by the one or more processors, the following steps are executed: while a first bottom-hole assembly ("BHA") and a first drilling rig together attempt to drill a first wellbore segment along a first planned trajectory, executing a first test scenario on the first drilling rig by varying one or more first operating parameters of the first drilling rig in a predetermined manner during a first predetermined time interval; receiving one or more first performance characteristics monitored by one or more first sensors of the first BHA during the first predetermined time interval; comparing the predetermined manner in which the first operating parameter(s) of the first drilling rig were varied during the first predetermined time interval to the received first performance characteristic(s) monitored by the first sensor(s) of the first BHA during the first predetermined time interval; and based on said comparison, controlling the first operating parameter(s) of a second drilling rig while a second BHA operably associated with the second drilling rig attempts to drill a second wellbore segment along a second planned trajectory. In one or more embodiments, the first and second drilling rigs are the same drilling rig; the first and second BHAs are the same BHA; and the first and second wellbore segments are part of the same wellbore. In one or more embodiments, when the instructions are executed by the one or more processors, the following steps are further executed: receiving the first planned trajectory of the first wellbore segment; receiving the second planned trajectory of the second wellbore segment; comparing the second planned trajectory to the first planned trajectory; and based on said comparison, controlling the first operating parameter(s) of the second drilling rig while the second BHA operably associated with the second drilling rig attempts to drill the second wellbore segment along the second planned trajectory. In one or more embodiments, when the instructions are executed by the one or more processors, the following step is further executed: before executing the first test scenario on the first drilling rig, communicating, to the first BHA: the first predetermined time interval during which the first operating parameter(s) of the first drilling rig are to be varied when the first test scenario is executed on the first drilling rig; and a request for the first BHA to monitor, using the first sensor(s), the first performance characteristic(s) during the first predetermined time interval. In one or more embodiments, when the instructions are executed by the one or more processors, the following steps are further executed: while the first BHA and the first drilling rig together attempt to drill the first wellbore segment along the first planned trajectory, executing a second test scenario on the first drilling rig by varying one or more second operating parameters of the first drilling rig in a predetermined manner during a second predetermined time interval; receiving one or more second performance characteristics monitored by one or more second sensors of the first BHA during the second predetermined time interval; comparing the predetermined manner in which the second operating parameter(s) of the first drilling rig were varied during the second predetermined time interval to the received second performance characteristic(s) monitored by the second sensor(s) of the first BHA during the second predetermined time interval; and based on said comparison, controlling the second operating parameter(s) of the second drilling rig while the second BHA operably associated with the second drilling rig attempts to drill the second wellbore segment along the second planned trajectory. In one or more embodiments, at least one of the first sensor(s) of the first BHA and at least one of the second sensor(s) of the first BHA are the same sensor(s). In one or more embodiments, at least one of the first performance characteristic(s) and at least one of the second performance characteristic(s) are the same performance characteristic(s). In one or more embodiments, at least one of the first operating parameter(s) and at least one of the second operating parameter(s) are the same operating parameter(s). In one or more embodiments, when the instructions are executed by the one or more processors, the following step is further executed: before executing the first and second test scenarios on the first drilling rig, communicating, to the first BHA: the first predetermined time interval during which the first operating parameter(s) of the first drilling rig are to be varied when the first test scenario is executed on the first drilling rig; a request for the first BHA to monitor, using the first sensor(s), the first performance characteristic(s) during the first predetermined time interval; the second predetermined time interval during which the second operating parameter(s) of the first drilling rig are to be varied when the second test scenario is executed on the first drilling rig; and a request for the first BHA to monitor, using the second sensor(s), the second performance characteristic(s) during the second predetermined time interval. In one or more embodiments, the first BHA and the first drilling rig together attempt to drill the first wellbore segment along the first planned trajectory by: moving, using the first drilling rig, a tubular string extending from the first drilling rig, into a wellbore, and to the first BHA; circulating, using the first drilling rig, a drilling fluid through wellbore via the tubular string; and drilling, using the first BHA, to extend the wellbore.

It is understood that variations may be made in the foregoing without departing from the scope of the present disclosure.

In one or more embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures.

In one or more embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

while a first bottom-hole assembly ("BHA") and a first drilling rig together drill a first wellbore segment along a first planned trajectory, executing a first test scenario on the first drilling rig by varying one or more operating parameters of the first drilling rig in a predetermined manner during a first predetermined time interval;

receiving one or more performance characteristics monitored by one or more sensors of the first BHA during the first predetermined time interval;

comparing the predetermined manner in which the operating parameter(s) of the first drilling rig were varied during the first predetermined time interval to the received performance characteristic(s) monitored by the sensor(s) of the first BHA during the first predetermined time interval; and based on said comparison, either:

controlling the first drilling rig while the first BHA operably associated with the first drilling rig drills a second wellbore segment along a second planned trajectory, said first and second wellbore segments being part of a first wellbore; or controlling a second drilling rig while a second BHA operably associated with the second drilling rig drills the second wellbore segment along the second planned trajectory, said first and second wellbore segments being part of the first wellbore and a second wellbore, respectively.

2. The method of claim 1, further comprising:

receiving the first planned trajectory of the first wellbore segment;

receiving the second planned trajectory of the second wellbore segment;

comparing the second planned trajectory to the first planned trajectory; and based on said comparison, either:

controlling the first drilling rig while the first BHA operably associated with the first drilling rig drills the second wellbore segment along the second planned trajectory, said first and second wellbore segments being part of the first wellbore; or controlling the second drilling rig while the second BHA operably associated with the second drilling rig drills the second wellbore segment along the second planned trajectory, said first and second wellbore segments being part of the first wellbore and the second wellbore, respectively.

3. The method of claim 1, further comprising:

before executing the first test scenario on the first drilling rig, communicating, to the first BHA:

the first predetermined time interval during which the operating parameter(s) of the first drilling rig are to be varied when the first test scenario is executed on the first drilling rig; and a request for the first BHA to monitor, using the sensor(s), the performance characteristic(s) during the first predetermined time interval.

4. The method of claim 1, further comprising:

while the first BHA and the first drilling rig together drill the first wellbore segment along the first planned trajectory, executing a second test scenario on the first drilling rig by varying at least one of the one or more operating parameters of the first drilling rig in a predetermined manner during a second predetermined time interval;

receiving at least one of the one or more performance characteristics monitored by at least one of the one or more sensors of the first BHA during the second predetermined time interval;

comparing the predetermined manner in which the operating parameter(s) of the first drilling rig were varied during the second predetermined time interval to the received performance characteristic(s) monitored by the sensor(s) of the first BHA during the second predetermined time interval; and based on said comparison, either:

controlling the first drilling rig while the first BHA operably associated with the first drilling rig drills the second wellbore segment along the second planned trajectory, said first and second wellbore segments being part of the first wellbore; or controlling the second drilling rig while the second BHA operably associated with the second drilling rig drills the second wellbore segment along the second planned trajectory, said first and second wellbore segments being part of the first wellbore and the second wellbore, respectively.

5. The method of claim 4, further comprising:

before executing the first and second test scenarios on the first drilling rig, communicating, to the first BHA:

the first predetermined time interval during which the operating parameter(s) of the first drilling rig are to be varied when the first test scenario is executed on the first drilling rig;

a request for the first BHA to monitor, using the sensor(s), the performance characteristic(s) during the first predetermined time interval;

the second predetermined time interval during which the at least one of the operating parameter(s) of the first drilling rig are to be varied when the second test scenario is executed on the first drilling rig; and a request for the first BHA to monitor, using the at least one of the sensor(s), the at least one of the performance characteristic(s) during the second predetermined time interval.

6. The method of claim 1, wherein the first BHA and the first drilling rig together drill the first wellbore segment along the first planned trajectory by:

moving, using the first drilling rig, a tubular string, said tubular string extending from the first drilling rig, into the first wellbore, and to the first BHA;

circulating, using the first drilling rig, a drilling fluid through the first wellbore via the tubular string; and drilling, using the first BHA, to extend the first wellbore.

7. An apparatus, comprising:

a non-transitory computer readable medium; and a plurality of instructions stored on the non-transitory computer readable medium and executable by one or more processors, wherein, when the instructions are executed by the one or more processors, the following steps are executed:

while a first bottom-hole assembly ("BHA") and a first drilling rig together drill a first wellbore segment along a first planned trajectory, executing a first test scenario on the first drilling rig by varying one or more operating parameters of the first drilling rig in a predetermined manner during a first predetermined time interval;

receiving one or more performance characteristics monitored by one or more sensors of the first BHA during the first predetermined time interval;

comparing the predetermined manner in which the operating parameter(s) of the first drilling rig were varied during the first predetermined time interval to the received performance characteristic(s) monitored by the sensor(s) of the first BHA during the first predetermined time interval; and based on said comparison, either:

controlling the first drilling rig while the first BHA operably associated with the first drilling rig drills a second wellbore segment along a second planned trajectory, said first and second wellbore segments being part of a first wellbore; or controlling a second drilling rig while a second BHA operably associated with the second drilling rig drills the second wellbore segment along the second planned trajectory, said first and second wellbore segments being part of the first wellbore and a second wellbore, respectively.

8. The apparatus of claim 7, wherein, when the instructions are executed by the one or more processors, the following steps are further executed:

receiving the first planned trajectory of the first wellbore segment;

receiving the second planned trajectory of the second wellbore segment;

comparing the second planned trajectory to the first planned trajectory; and based on said comparison, either:

controlling the first drilling rig while the first BHA operably associated with the first drilling rig drills the second wellbore segment along the second planned trajectory, said first and second wellbore segments being part of the first wellbore; or controlling the second drilling rig while the second BHA operably associated with the second drilling rig drills the second wellbore segment along the second planned trajectory, said first and second wellbore segments being part of the first wellbore and the second wellbore, respectively.

9. The apparatus of claim 7, wherein, when the instructions are executed by the one or more processors, the following step is further executed:

before executing the first test scenario on the first drilling rig, communicating, to the first BHA:

the first predetermined time interval during which the operating parameter(s) of the first drilling rig are to be varied when the first test scenario is executed on the first drilling rig; and a request for the first BHA to monitor, using the sensor(s), the performance characteristic(s) during the first predetermined time interval.

10. The apparatus of claim 7, wherein, when the instructions are executed by the one or more processors, the following steps are further executed:

while the first BHA and the first drilling rig together drill the first wellbore segment along the first planned trajectory, executing a second test scenario on the first drilling rig by varying at least one of the one or more operating parameters of the first drilling rig in a predetermined manner during a second predetermined time interval;

receiving at least one of the one or more performance characteristics monitored by at least one of the one or more sensors of the first BHA during the second predetermined time interval;

comparing the predetermined manner in which the operating parameter(s) of the first drilling rig were varied during the second predetermined time interval to the received performance characteristic(s) monitored by the sensor(s) of the first BHA during the second predetermined time interval; and based on said comparison, either:

controlling the first drilling rig while the first BHA operably associated with the first drilling rig drills the second wellbore segment along the second planned trajectory, said first and second wellbore segments being part of the first wellbore; or controlling the second drilling rig while the second BHA operably associated with the second drilling rig drills the second wellbore segment along the second planned trajectory, said first and second wellbore segments being part of the first wellbore and the second wellbore, respectively.

11. The apparatus of claim 10, wherein, when the instructions are executed by the one or more processors, the following step is further executed:

before executing the first and second test scenarios on the first drilling rig, communicating, to the first BHA:

the first predetermined time interval during which the operating parameter(s) of the first drilling rig are to be varied when the first test scenario is executed on the first drilling rig;

a request for the first BHA to monitor, using the sensor(s), the performance characteristic(s) during the first predetermined time interval;

the second predetermined time interval during which the at least one of the operating parameter(s) of the first drilling rig are to be varied when the second test scenario is executed on the first drilling rig; and a request for the first BHA to monitor, using the at least one of the sensor(s), the at least one of the performance characteristic(s) during the second predetermined time interval.

12. The apparatus of claim 7, wherein the first BHA and the first drilling rig together drill the first wellbore segment along the first planned trajectory by:

moving, using the first drilling rig, a tubular string, said tubular string extending from the first drilling rig, into the first wellbore, and to the first BHA;

circulating, using the first drilling rig, a drilling fluid through the first wellbore via the tubular string; and drilling, using the first BHA, to extend the first wellbore.

* * * * *